US008695504B2

(12) United States Patent
Guth et al.

(10) Patent No.: US 8,695,504 B2
(45) Date of Patent: Apr. 15, 2014

(54) ACTIVATION UNIT FOR MUNITION-FREE DECOYS

(75) Inventors: Sven Guth, Müllheim (DE); Heribert Eglauer, Berchtesgaden (DE); Frank Oliver, Siegsdorf (DE); Florian Huber, Anger (DE); Nenad Prelic, Anger (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 167 days.

(21) Appl. No.: 12/969,253

(22) Filed: Dec. 15, 2010

(65) Prior Publication Data

US 2011/0174182 A1 Jul. 21, 2011

Related U.S. Application Data

(63) Continuation-in-part of application No. PCT/EP2009/004114, filed on Jun. 8, 2009.

(30) Foreign Application Priority Data

Jun. 16, 2008 (DE) ..... 10 2008 028 245
May 8, 2009 (DE) ..... 10 2009 020 558

(51) Int. Cl.
*F42B 4/00* (2006.01)
*F42B 4/26* (2006.01)
*F23Q 7/02* (2006.01)

(52) U.S. Cl.
USPC ..... 102/205; 102/357; 102/342; 102/202.14

(58) Field of Classification Search
USPC ..... 102/336, 340, 342, 346, 351, 357, 102/202.14, 205
See application file for complete search history.

(56) References Cited

U.S. PATENT DOCUMENTS 2,678,603 A 5/1954 Prince, Jr. et al.
2,787,217 A 4/1957 Mahaffie (Continued)

FOREIGN PATENT DOCUMENTS

CA 2146015 A1 2/1995
DE 649 530 C 8/1937

(Continued)

OTHER PUBLICATIONS

International Search Report issued in International Application No. PCT/EP2009/004113, completed Sep. 29, 2009, mailed Oct. 6, 2009.

(Continued)

*Primary Examiner* — James Bergin
(74) *Attorney, Agent, or Firm* — Griffin & Szipl, P.C.

(57) ABSTRACT

An activation unit (1, 10) for munitions-free decoys, active masses or active bodies (3) is characterized by an ejector tube (2) and a high-powered heater element (4) arranged around the ejector tube (2, 12), wherein the heater element is made up of at least one heating wire (6), provided with electrical current by a regulator unit. Each heating wire (6) is enclosed in a sleeve (7) and embedded in at least one heat-loss minimizing material. The active body (3) passing through the activation unit (1,10) directly or indirectly contacts with the individual elements (4) of the activation unit (1, 10). Thermal energy is transmitted to the active body (3) from the heating wires (6), which ignites at the touching or contact point.

20 Claims, 5 Drawing Sheets

(56) References Cited

U.S. PATENT DOCUMENTS

| | | | | | |
|---|---|---|---|---|---|
| 3,216,410 | A | | 11/1965 | Trombatore et al. | |
| 3,628,416 | A | * | 12/1971 | Kernan | 89/1.51 |
| 3,760,729 | A | | 9/1973 | Freeman | |
| 4,002,122 | A | | 1/1977 | Gould | |
| 4,060,435 | A | | 11/1977 | Schroeder | |
| 4,068,591 | A | * | 1/1978 | Betts | 102/202.14 |
| 4,096,804 | A | | 6/1978 | Bilsbury | |
| 4,374,494 | A | | 2/1983 | Maury | |
| 4,409,898 | A | | 10/1983 | Blix et al. | |
| 4,624,186 | A | | 11/1986 | Widera et al. | |
| 4,838,167 | A | | 6/1989 | Prahauser et al. | |
| H0000778 | H | | 5/1990 | Carlton et al. | |
| 5,074,216 | A | * | 12/1991 | Dunne et al. | 102/334 |
| 5,635,666 | A | | 6/1997 | Bannasch et al. | |
| 5,929,369 | A | | 7/1999 | Bissig et al. | |
| 5,992,327 | A | | 11/1999 | Wardecki et al. | |
| 6,055,909 | A | | 5/2000 | Sweeny | |
| 6,427,599 | B1 | | 8/2002 | Posson et al. | |
| 6,513,438 | B1 | | 2/2003 | Fegg et al. | |
| 6,659,012 | B1 | | 12/2003 | Grassi et al. | |
| 6,666,351 | B1 | | 12/2003 | Hartz et al. | |
| 7,343,861 | B1 | | 3/2008 | Baker | |
| 7,363,861 | B2 | | 4/2008 | Brune et al. | |
| 7,421,950 | B2 | | 9/2008 | Dillard et al. | |
| 7,516,700 | B1 | | 4/2009 | Callaway | |
| 7,584,702 | B1 | | 9/2009 | Sutherland et al. | |
| 7,866,265 | B1 | | 1/2011 | Kravel et al. | |
| 7,992,496 | B2 | | 8/2011 | Dillard et al. | |
| 8,146,504 | B2 | * | 4/2012 | Wallner et al. | 102/505 |
| 8,276,518 | B2 | | 10/2012 | Dillard et al. | |
| 2002/0011173 | A1 | | 1/2002 | Schildknecht et al. | |
| 2003/0116050 | A1 | | 6/2003 | Brum et al. | |
| 2004/0139876 | A1 | | 7/2004 | Wilson et al. | |
| 2004/0244626 | A1 | | 12/2004 | Ehmig | |
| 2006/0032391 | A1 | | 2/2006 | Brune et al. | |
| 2006/0201372 | A1 | * | 9/2006 | Nicolae | 102/342 |
| 2007/0039505 | A1 | | 2/2007 | Dillard et al. | |
| 2009/0007768 | A1 | | 1/2009 | Wallner et al. | |
| 2009/0095186 | A1 | | 4/2009 | Dillard et al. | |
| 2009/0301336 | A1 | | 12/2009 | Wardecki et al. | |
| 2010/0288111 | A1 | | 11/2010 | Kunz | |
| 2011/0146520 | A1 | * | 6/2011 | Guth | 102/342 |
| 2011/0174182 | A1 | * | 7/2011 | Guth et al. | 102/202.14 |
| 2012/0137913 | A1 | | 6/2012 | Prelic et al. | |
| 2012/0160121 | A1 | * | 6/2012 | Prelic et al. | 102/336 |

FOREIGN PATENT DOCUMENTS

| | | | |
|---|---|---|---|
| DE | 2359758 | C1 | 7/1988 |
| DE | 94 14 263 | U1 | 10/1994 |
| DE | 197 56 204 | C1 | 3/1999 |
| DE | 199 10 074 | A1 | 9/2000 |
| DE | 199 51 767 | A1 | 5/2001 |
| DE | 103 23 531 | B3 | 2/2005 |
| DE | 10 2005 020 159 | A1 | 11/2006 |
| DE | 10 2006 004 912 | A1 | 7/2007 |
| DE | 196 49 892 | A1 | 7/2008 |
| DE | 10 2007 032 112 | A1 | 1/2009 |
| DE | 102009020558 | A1 | 11/2010 |
| DE | 10 2009 030 868 | A1 | 1/2011 |
| EP | 0 204 115 | A2 | 12/1986 |
| FR | 715 614 | A | 12/1931 |
| GB | 250 271 | A | 10/1926 |
| JP | 11173796 | A | 7/1999 |
| WO | 00/19164 | A1 | 4/2000 |
| WO | 2007/087948 | A1 | 8/2007 |
| WO | 2010/003496 | A1 | 1/2010 |
| WO | 2010/019291 | A1 | 12/2010 |

OTHER PUBLICATIONS

International Search Report issued in International Application No. PCT/EP2009/004114, mailed Oct. 13, 2009, completed Oct. 1, 2009.
Office action issued in co-pending related U.S. Appl. No. 13/337,628 on Jun. 5, 2013.
Office Action issued in co-pending related U.S. Appl. No. 12/970,585 on Jun. 20, 2013.
Office Action issued in co-pending related U.S. Appl. No. 13/337,692 on Jun. 21, 2013.
English translation (Jan. 2012) of the Written Opinion of the International Searching Authority in PCT/EP2010/003565.
Notice of Allowance issued in co-pending related U.S. Appl. No. 13/380,959 on Aug. 22, 2013.
Office Action issued in co-pending related application on Sep. 5, 2013.
International Search Report issued in corresponding application PCT/EP2010/002332, completed Jun. 29, 2010 and mailed Jul. 6, 2010.
International Search Report and IPRP issued in PCT/EP2010/003565, completed Aug. 31, 2010 and mailed Sep. 7, 2010.
International Search Report and IPRP issued in PCT/EP2010/003566, completed Aug. 27, 2010 and mailed Sep. 7, 2010.
International Search Report and IPRP issued in PCT/EP2010/003567, completed Sep. 16, 2010 and mailed Sep. 22, 2010.
McGraw-Hill Dictionary of Scientific and Technical Terms (Sixth Ed.) 814 (2003).
"United States Naval Pyrotechnical Compositions," at http://www.google.com/urlsa=t&rct=j&q=&esrc=s&source=web&cd=9&ved=0CGYQFjAI&url=http%3A%2F%2Fwww.ammunitionpages.com%2Fdownload%2F237%2FUS%2520navy%2520-pyrotechnicspdf&ei=zjI6UsagMLXi4AOnw4Fw&usg=AFQjCNGhmQURaXkLjZAo1124l0jajOvmlg&sig2=vw04ff4-VMe_PYiiD8aZzw&bvm=bv.52434380,d.dmg (downloaded Sep. 18, 2013, five pages).
S.M. Danali et al., Developments in Pyrotechnics, 60 Defense Science Journal 152-158 (2010).
Clarence W. Gilliam et al., Flare, Igniter and Pyrotechnic Disposal: Red Phosphorous Smokes, Naval Ammunition Depot, AD-A013 182 (1975).
"Pyrotechnic Chemistry," at http://www.islandgroup.com/military/pyrotechnic_chemistry.php (2013)(downloaded Sep. 18, 2013, two pages).
Charles A. Knapp, New Infrared Flare and High-altitude Igniter Compositions, Feltman Research and Engineering Laboratories, Picatany Arsenal (1959).
Rui Shu, Explosive Chemistry: The History and Chemistry of Explosives, Dartmouth Undergraduate Journal of Science 21-23 (2012).
Gao Guangyan, Nitrocellulose Synthesis Outline, at http://www.loneoceans.com/labs/nitrocellulose/ (2012).
Random House Webster'S College Dictionary 506 (1991).
Notice of Allowance issued in co-pending related U.S. Appl. No. 13/380,959 on Nov. 26, 2013.
"Stainless Steels," at http://www.dew-stahl.com/fileadmin/files/dew-stahl.com/documents/Publikationen/Broschueren/015_DEW_RSH_GB.pdf (downloaded Dec. 2, 2013).

* cited by examiner

ACTIVATION UNIT FOR MUNITION-FREE DECOYS

This is a Continuation-in-Part Application in the United States of International Patent Application No. PCT/EP2009/004114 filed Jun. 8, 2009, which claims priority on German Patent Application No. 10 2008 028 245.6, filed Jun. 16, 2008, and on German Patent Application No. 10 2009 020 558.6, filed May 8, 2009. The entire disclosures of the above patent applications are hereby incorporated by reference.

FIELD OF THE INVENTION

The present invention pertains broadly to an activation unit for activating munitions-free active masses or active bodies or flares for the protection of aircraft against heat-seeking threats.

BACKGROUND OF THE INVENTION

Decoys and/or smoke shells, based, for example, on red phosphorus (RP) or nitrocellulose (NC), are used in military applications, such as smoke shells, infrared (IR)-acting aircraft decoys, etc., in order to spontaneously cover an area with hot particles, in order to, for example, mask a thermal image. The carrier is, in this case, generally broken up with the aid of a central fuze charge. During break-up, a flame front and a pressure front are formed, which, on the one hand, distribute the pyrotechnic films over an area, and, on the other hand, produce a flame front that ignites the pyrotechnic films. The smoke or IR effect is developed by the RP/NC after appropriate ignition by burning. The RP units (active bodies) are ignited via an ignition or break-up charge, which ensures that the active bodies can be optimally ignited, and can then burn for their respective purposes.

At the moment, Class 1 break-up systems are used to produce these massive pyrotechnic effects. This results in a very high classification of the active system and prevents its use for protection, for example, of civil aircraft, because it is forbidden to carry Class 1 substances/appliances in aircraft such as civilian aircraft. In other words, such decoys cannot be used in civil aviation environments because of the classification of the munition component, and because such explosives are not acceptable in this civilian context, and because there are International Safety Agreements, etc., that must be complied with.

Because of the above limitations pertaining to civilian aviation, a novel ignition concept has been developed, which does not require explosive and/or pyrophoric substances to ignite RP/NC flares.

This novel ignition concept is described in more detail in DE 10 2006 004 912 A1. This document discloses a system for protection, in particular, of large flying platforms, such as aircraft, against a threat guided by IR or radar. In this case, the active bodies are preferably activated, or ignited, contactlessly. The active bodies are then ejected pneumatically or mechanically. The active bodies themselves are munition-free packs, which are ignited by means of hot air or a laser.

Building on this activation, the present invention is based on the object of specifying an activation unit, which activates such active bodies in order to produce decoys. In other words, an object of the deployment system of the present invention is to provide ignition for an active body/flare that has an activation unit that permits its use for civilian purposes (i.e., with civilian aircraft, civilian vehicles, and the like), and that is not limited to use with military aircraft, vehicles, and the like.

SUMMARY OF THE INVENTION

The object of the invention is achieved by the features of a first embodiment, which pertains to an activation unit (1, 10) for munition-free active masses or active bodies (3) or flares (9, 11), for the protection of aircraft against heat-seeking threats, characterized by a heat transfer within the activation unit (1, 10) by heating elements (4), wherein the activation unit (1, 10) is formed by an ejection tube (2) and high-power heating elements (4), which are fitted around the ejection tube (2), and the heating elements (4) each consist of at least a heating wire (6), which is itself supplied with electric current by a regulation unit. Advantageous additional embodiments, in accordance with the present invention, can be found in the present disclosure as summarized below.

In accordance with a second embodiment of the present invention, the first embodiment is modified so that each heating wire (6) is held in a casing (7). In accordance with a third embodiment of the present invention, the first embodiment or the second embodiment is further modified so that the respective heating wire (6) is embedded at least in a material that minimizes heat loss. In accordance with a fourth embodiment of the present invention, the third embodiment is further modified so that the material is a ceramic inlay (8). In accordance with a fifth embodiment of the present invention, the first embodiment, the second embodiment, the third embodiment, and the fourth embodiment, of the present invention are further modified so that the heating elements (4) are held in the ceramics (8) for mechanical strain relief in a metal structure of the ejection tube (2), wherein the metal structure corresponds to the respective external shape of the active body (3).

In accordance with a sixth embodiment, of the present invention, the first embodiment, the second embodiment, the third embodiment, the fourth embodiment, and the fifth embodiment, are modified so that the active bodies (3), or flares (9, 11), can be accelerated mechanically, pneumatically or pyrotechnically. In accordance with a seventh embodiment of the present invention, the first embodiment, the second embodiment, the third embodiment, the fourth embodiment, the fifth embodiment, and the sixth embodiment, are further modified so that the tubular connection stub (10) has a conically tapering shape. In accordance with an eighth embodiment of the present invention, the first embodiment, the second embodiment, the third embodiment, the fourth embodiment, the fifth embodiment, the sixth embodiment, and the seventh embodiment, are further modified so that the tubular connecting stub (1) can be heated electrically and by a burner.

In accordance with a ninth embodiment of the present invention, an active body (3), fired through an activation unit that is an activation unit according to the first embodiment, the seconded embodiment, the third embodiment, the fourth embodiment, the fifth embodiment, the sixth embodiment, the seventh embodiment, and the eighth embodiment, is provided, wherein the active body (3) is formed from individual flares (9, 11). In accordance with a tenth embodiment of the present invention, the active body according to the ninth embodiment is modified so that the individual flares (9, 11) are coated. In accordance with an eleventh embodiment of the invention, the ninth and tenth embodiments are further modified so that the flares (11) are polygonal. In accordance with a twelfth embodiment of the present invention, the eleventh embodiment is modified so that the number of corners (E) is greater than two. In accordance with a thirteenth embodiment of the present invention, the eleventh embodiment and the twelfth embodiment are further modified so that the diagonal ($D_F$) between the corners (E) is greater than the front internal diameter ($D_{IR-2}$), and the second, rear internal diameter ($D_{IR-1}$) is itself greater than or equal to the diagonals ($D_F$). In accordance with a fourteenth embodiment of the present invention, the ninth embodiment, the tenth embodiment, and the eleventh embodiment are further modified so that the individual flares 9, 11 are corners/side edges that can be bent over.

Fundamentally, the invention is based on the above-mentioned idea of activating (i.e., of igniting) the active masses/flare material by supplying thermal energy. This avoids the use of explosives because active mass/flare material ignition is achieved due to a heat source and not due to an explosive.

For this purpose mentioned above, in accordance with a preferred embodiment, an ignition tube, from which the active masses are ejected, has a high-temperature activation element that consists essentially of "n" heating elements, which are arranged geometrically separately from one another, and radially around the circumference of the ignition tube. The material chosen for the individual heating elements allows temperatures of more than 600° C., with the heating elements being designed such that they allow extremely dynamic heating, because the masses are small. Ceramic inlays are provided in order to minimize heat losses and in order to further thermally optimize the activation unit. This thermal optimization, and appropriate control engineering, result in an extremely short reaction time of the heating elements. That is to say that the heating time from the switch-on point to reaching the nominal temperature for ignition is extremely short (low or small).

Any desired number of heating elements may be used and may be selected in accordance with the present invention, and the heating elements may, in principle, be prefabricated in any shape. It is therefore possible to ideally set the energy introduction for each application, on the one hand, by the choice of the number "n" of the heating elements and/or, on the other hand, by adapted control engineering.

Depending on the application, the active body can be ignited by contact with the heating elements, or else the active body can be ignited contactlessly (e.g., due to transmission of heat energy without direct contact). To this end, it is possible to activate the active body as it "flies past" the heated walls of the ignition tube.

This form of activation, by using heat transmitted contactlessly or via direct contact with a heated surface, allows the use of decoys without explosives in the civil environment, which not only pertains to use in civil aviation, but also permits use with civil seaborne targets and land vehicles, and with military environments. The design and safety requirements for decoys and dispensers without employing explosives are simpler. That is to say that the design and safety requirements are considerably less stringent when active mass/flare material can be ignited without explosives. The ignition unit or ignition apparatus enables a multiplicity of ignition operations, while devices used for traditional flares are generally intended to be used only once.

The second solution principle is represented by a preferably conically tapering tubular connecting stub, which can be heated to the specific temperature capable of causing ignition, and by means of which films with a pyrotechnic coating, or a comparable coating, can be ignited. In this way, the ignitable coating films are ignited during axial relative movement within the heated walls of the tubular connecting stub. Once the coated films of the active body/flare are ignited in the tubular connecting stub, then the ignited active body/flare may leave the tubular connecting stub while still burning so as to provide the decoy, smoke screening effect against heat-seeking threats.

During relative movement of the coated polygonal films of the active bodies/flares in the heated tubular connecting stub, their corners slide along the connecting stub length and are ignited by heat transfer produced in the corners touching the tubular connecting stub, or alternatively, in the corners moving close to, but not actually touching, the heated wall of the tubular connecting stub.

The tapering profile for the tubular connecting stub is, therefore, a preferred embodiment to ensure the ignition of the ignitable coating of the active body/flare. The contact area between the ignitable coated film and the (conical) tubular connecting stub increases continuously during relative movement of the active body/flare in the tubular connecting stub, and, therefore, enhances the functional reliability regarding ignition of the active body/flare by heat transfer from the tubular connecting stub.

The (conical) tubular connecting stub can be heated both electrically and by a burner, etc. The active signature starts without delay with respect to the ejection of the ignited coated films, and enhances the effectiveness of the protection system.

The coated films are preferably designed with a specific polygonal geometry. The functional reliability of the ignition increases in proportion to the number of corners of the coated films.

The coated films can be deployed individually or else in layers in a pack, which considerably enhances the effectiveness of the protection system of the present invention. Furthermore, radial rotation of the coated films within the tubular connecting stub is irrelevant to their effectiveness when igniting the ignitable coating films.

The advantages of this ignition system of the present invention are, in addition to the very high functional ignition reliability with a low failure rate, little maintenance effort, low costs and adequate safety during transportation and in operation. This is achieved due to the fact that the coated films are accelerated in a separate acceleration system, which is at the same time decoupled from the heat, and is disposed before the heated tube or heated tubular connecting stub. The coated films can be accelerated mechanically (for example, by a spindle drive of the deployment system 12), pneumatically (for example by compressed air provided by a pneumatic system of the deployment system 12), or else pyrotechnically (e.g., by using a pyrotechnic mechanism).

BRIEF DESCRIPTION OF THE DRAWINGS

The invention will be explained in more detail with reference to one or more exemplary embodiments and a drawing, in which.

DETAILED DESCRIPTION OF THE INVENTION

Figure 1:
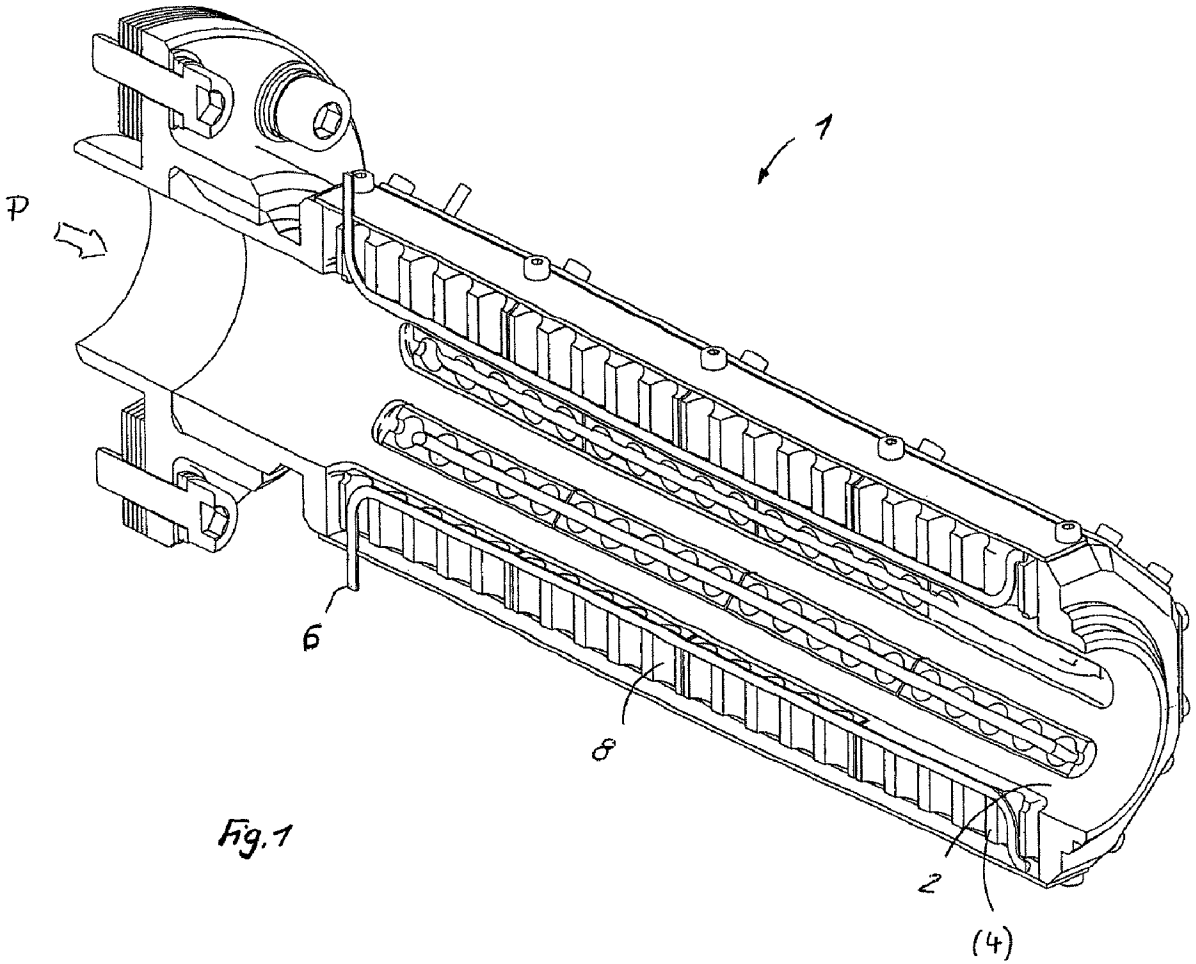
FIG. 1 shows a cross-sectional perspective view of an activation unit with an ejection tube for an active body, in accordance with the present invention.

In the sectional view illustrated in FIG. 1, 1 denotes an activation unit. The high-temperature activation unit 1 essentially consists of an ejection tube 2 from which an active body 3 (FIG. 3), which is not illustrated in any more detail, is ejected in the direction of the arrow P. The ejection tube 2 is surrounded by high-temperature heating elements 4, with each individual element 4 being formed from a heating wire 6 that is held in a casing 7, so as to be protected against external influences. Each individual wire 6 is preferably embedded in a material that minimizes heat loss, preferably in a ceramic inlay 8. For mechanical strain relief, these ceramics 8 are held in the metal structure of the ejection tube 2, with the metal structure corresponding to the external shape of the active body 3, in this case a cylindrical shape.

The heating wires 6 are supplied by appropriate control engineering (not illustrated in any more detail) with appropriate electrical energy, and are thus heated to more than 600° C. The ceramic inlays 8 themselves improve the energy budget of the respective heating element 4, and, in the process, ensure more efficient introduction of energy to the active body 3.

Figure 2:
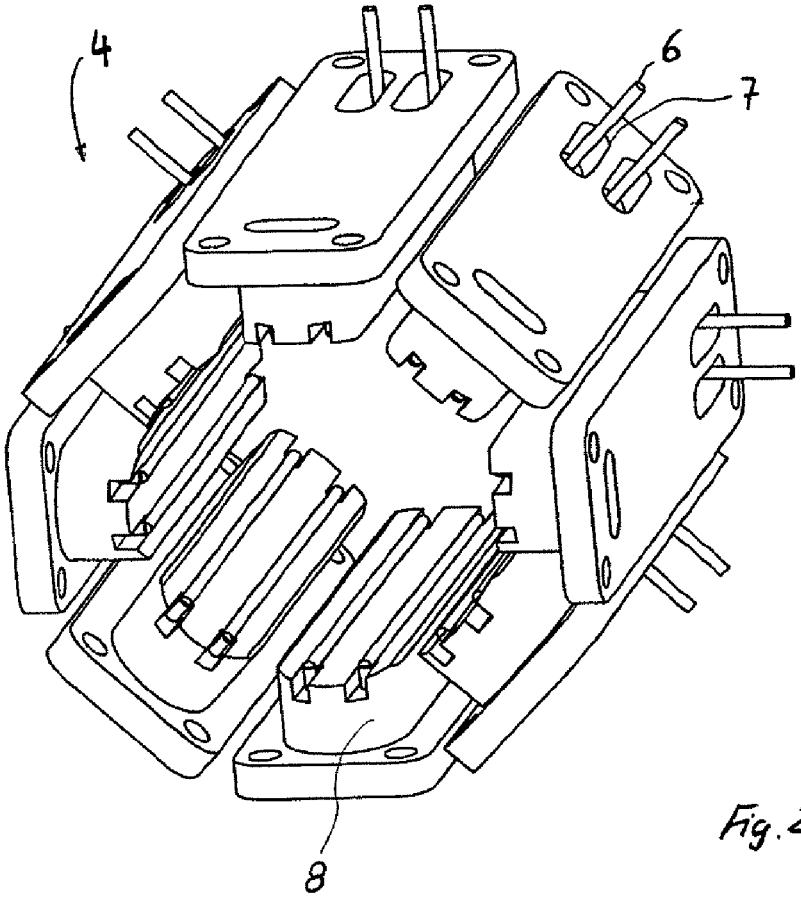
FIG. 2 shows heating elements of the activation unit from FIG. 1.

FIG. 2 shows a variant of the arrangement and of the design of the heating elements 4.

Figure 3:
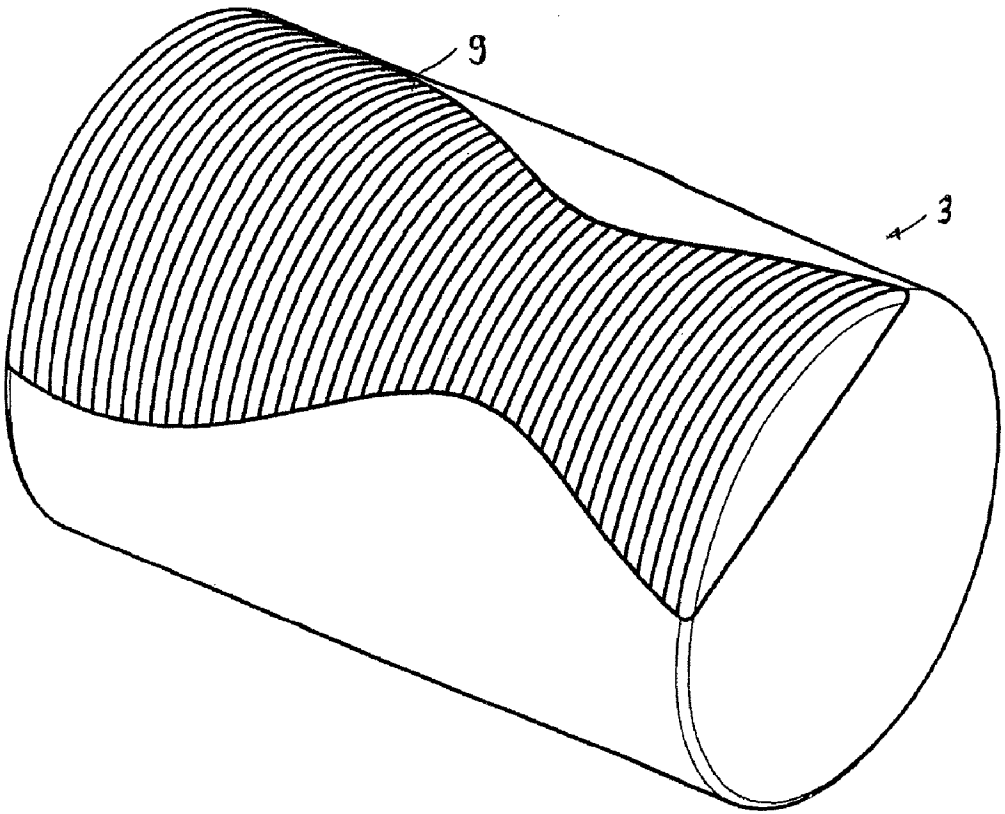
FIG. 3 shows an active body that is to be fed out of the ejection tube.

FIG. 3 shows the design of the active body 3, which is distinguished by a plurality of individual flares 9.

Figure 4:
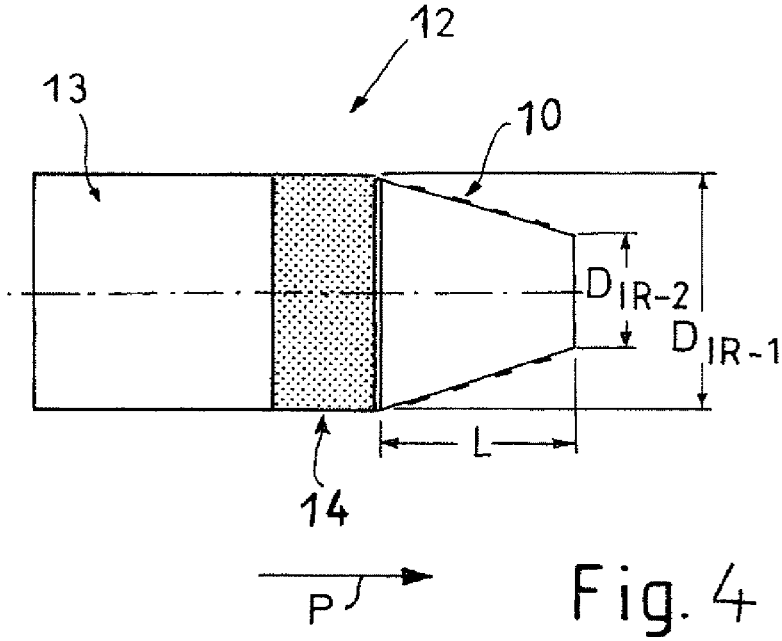
FIG. 4 shows a cross-sectional, schematic view of a conically tapering tubular connecting stub, as a basic unit of the ignition system and ignition process of the present invention.

The function of the active body/flare deployment system of the present invention is as follows:

By way of example, the active body 3 is forced through the activation unit 1 by a plunger (see ejection unit 12 of FIG. 4—not illustrated in any more detail). When the active body 3 passes through the activation unit 1 of FIG. 1 (See also activation unit 10 of FIG. 4), the casing surface on the active body 3 makes contact with the individual elements 4 of the activation unit 1. Then, thermal energy is transferred (directly or indirectly) through the heating wires 6 to the active body 3, or to the individual flare 9, which is ignited at the touching or contact points. Thermal energy may be transferred directly from the heated ejection tube 2 to the active body 3 when the active body comes into direct contact with the heated walls of the ejection tube 2. Thermal energy may also be transferred indirectly from the wall of the heated ejection tube to the active body 3 even though no direct contact occurs between the active body and the ejection tube 2. After emerging from the activation unit through an opening at one end of the activation unit, the ignited active body 3 can burn through completely, and can develop its radiation (IR radiation) used to provide protection from heat-seeking threats.

As already mentioned above, as an alternative to making direct contact, contactless activation is also possible, in which case it is necessary to ensure that the individual flares 9 (11) of the active body 3 are ignited due to transfer of sufficient heat from the heated ejection tube 2.

Figure 6:
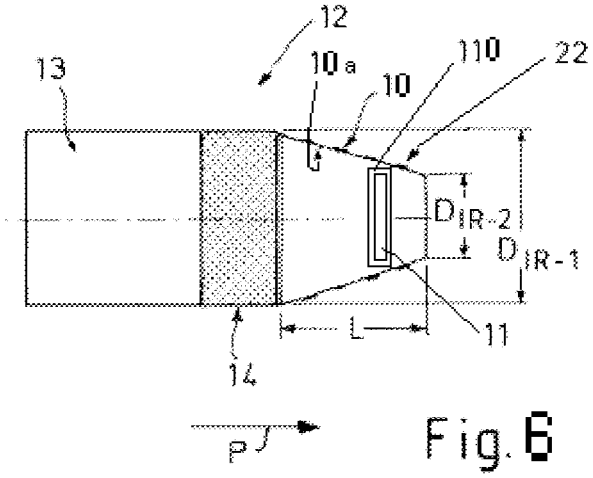
FIG. 6 shows a cross-sectional, schematic view of an active body or flare disposed inside the conically tapering tubular connecting stub of the active body/flare ignition system of the present invention and prior to ejection by the active body/flare ejection system.

In FIGS. 4 and 6, 10 denotes a preferably conically tapering tubular connecting stub (activation unit 10), which is provided with a heating element 22 of an active body/flare deployment system 12 (also referred to as an active body/flare ejection system) for the active body 3 or the individual flare 9 or 11. The tubular connecting stub 10 has a first, front internal diameter $D_{IR-2}$ as well as a second, rear internal diameter $D_{IR-1}$/as well as a length L. The deployment system 12 furthermore has an acceleration unit 13 and insulation 14 in order to provide thermal decoupling between the ignition unit 10 and acceleration unit 13. The second internal diameter $D_{IR-1}$ is, in this case, equal to the diameter of the insulation 14 and of the acceleration unit 13. P denotes the axial movement direction of the film 11*a* (or of the flare 11) inside the tubular connecting stub 10.

Figure 5:
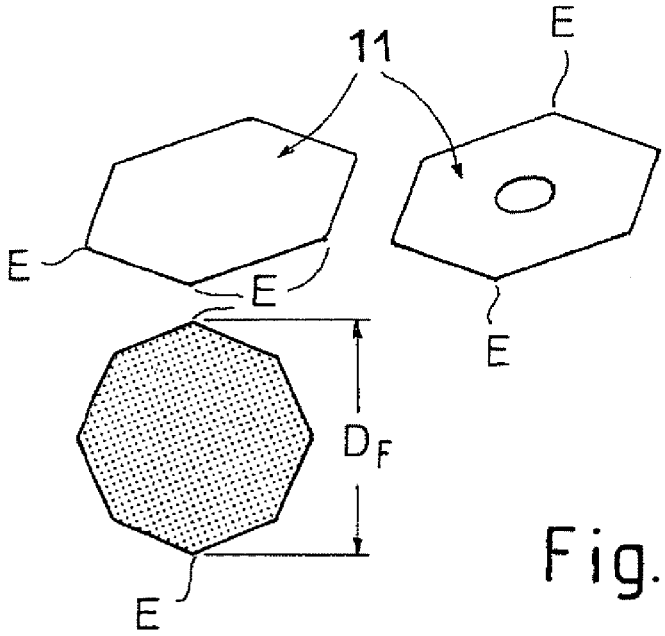
FIG. 5 shows a geometrically preferred illustration of a flare in accordance with the present invention.

FIG. 5 shows a further variant of the invention, in which a flare 11 is a polygonal, coated flare provided with an ignitable coating 110 (See FIG. 6 as well). The number of corners E should be greater than three. The diagonal $D_F$ between the corners E is, in this case, greater than the front internal diameter $D_{IR-2}$. The second, rear internal diameter $D_{IR-1}$ is itself greater than or equal to the diagonals $D_F$. The corners E slide during relative movement—in the direction P—in the heated tube 10 along the length L and are ignited by the heat transfer produced in the corners E, which make contact with the walls 10*a* of the tubular connecting stub 10. In the alternative, for contactless ignition, heat is transferred from the walls 10*a* to the corners E that slide sufficiently close to the walls 10*a* of the heated tubular connecting stub 10, thereby heating the ignitable coating 110 of the active body or flare 11 so that it ignites without direct contact with the wall 10*a* of the tubular connecting stub 10. Subject to the condition described above, the contact area between the coated film 110 and the correspondingly conical tubular connecting stub 10 increases continuously along the P direction during relative movement due to the taper of the tubular connecting stub 10. In this context, the term "contact area" should be construed broadly to include area of the coated film 110 heated by direct contact with heated wall 10*a* as well as area of the coated film 110 heated indirectly due to sufficiently close proximity to the heated wall 10*a*.

In sum then, the activation system (ignition system) of the present invention includes a heating element 22 of the deployment system 12, wherein the heating element is a burner or an electrical device (See FIG. 6). The heating element is disposed and/or connected to the tube 10 so as to heat the tube. Thus, the tube 10 is also part of the activation system of the invention. An active body or flare 11 is disposed inside the tube 10, as shown in FIG. 6, and the flare 11 is provided with an ignitable coating 110 (e.g., a pyrotechnic film). As the flare 11 moves in direction P inside the tube 10, more of the ignitable coating 110 on the surface of the flare 11 comes in contact with the inside wall 10*a* of the tube 10. In the alternative, for contactless ignition, the ignitable coating 110 on the surface of the flare 11 approaches close to the inside wall 10*a* of the tube 10. Consequently, as more surface of the ignitable coating 110 comes into contact with the heated inner wall 10*a* of the tube 10, or just comes into close proximity to the heated inner wall 10*a* of tube 10, heat transfer from the heated tube 10 to the ignitable coating 11 increases, thereby igniting the ignitable (pyrotechnic) film 110 of the flare 11. In this manner, the activation system of the present invention ignites the flare 11 by heat transfer. The ignited flare 11 then continues moving along axial direction P and is ejected from an open end of the tube 10 by operation of the acceleration unit 13 of the ejection system 12.

In order to ensure adequate ignition, the films 110 or individual flares 11 (9) could, for example, have corners/side edges that can be bent over (also partially), via which the heat transfer likewise takes place when the film is accelerated along the inner wall 10*a* of the tube or tubular connecting stub 10.

The invention claimed is:

1. An activation unit for activating munitions-free active masses, or active bodies, or flares, used to protect aircraft against heat-seeking threats, wherein the activation unit comprises:

(a) an ejection tube, wherein the ejection tube comprises a tubular connection stub that has a conically tapering shape; and (b) one or more high-power heating elements that are fitted around the ejection tube, wherein the one or more heating elements each include at least a heating wire that is supplied with electric current by a regulation unit, wherein the one or more heating elements are disposed to transfer heat to an active body within the activation unit.

2. The activation unit as claimed in claim 1, wherein each heating wire is held in a casing.

3. The activation unit as claimed in claim 2, wherein each heating wire is embedded at least in a material that minimizes heat loss.

4. The activation unit as clamed in claim 3, wherein the material is a ceramic inlay.

5. The activation unit as claimed in claim 1, wherein the one or more heating elements are held in ceramic that provides mechanical strain relief in a metal structure of the ejection tube, wherein the metal structure corresponds to a respective external shape of an active body disposed to be activated by the activation unit.

6. An active body, fired through the activation unit as claimed in claim 5, wherein the active body comprises a plurality of individual flares.

7. The active body as claimed in claim 6, wherein each individual flare is coated with an ignitable coat.

8. The active body as claimed in claim 7, wherein the individual flares are polygonal.

9. The active body as claimed in claim 8, wherein each individual flare includes a number of corners, and the number of corners is greater than two.

10. The active body as claimed in claim 6, wherein the individual flares are polygonal.

11. The active body as claimed in claim 10, wherein each individual flare includes a number of corners, and the number of corners is greater than two.

12. The active body as claimed in claim 10, wherein the ejection tube comprises a tapering tubular connecting stub that has a rear internal diameter and a front internal diameter, wherein a diagonal between corners of each individual flare is greater than the front internal diameter, and the rear internal diameter is greater than or equal to the diagonal.

13. The active body as claimed in claim 6, wherein the corners, or side edges, or the corners and side edges, of each individual flare is bent over.

14. The activation unit as claimed in claim 1, wherein the activation unit is connected to an acceleration unit that is disposed to mechanically, pneumatically or pyrotechnically accelerate an active body or a flare through the activation unit in an axial direction.

15. The activation unit as claimed in claim 14, wherein the acceleration unit comprises a spindle drive, and the active body or the flare is mechanically accelerated by the spindle drive of the acceleration unit.

16. The activation unit as claimed in claim 14, wherein the acceleration unit comprises a pneumatic system, and the active body or the flare is pneumatically accelerated by the pneumatic system of the acceleration unit.

17. The activation unit as claimed in claim 1, wherein the tubular connecting stub is heated electrically by the one or more high-power heating elements and by a burner.

18. An activation unit for activating munitions-free active masses, or active bodies, or flares, used to protect aircraft against heat-seeking threats, wherein the activation unit comprises:

(a) an ejection tube;

(b) one or more high-power heating elements that are fitted around the ejection tube, wherein the one or more heating elements each include at least a heating wire that is supplied with electric current by a regulation unit, wherein the one or more heating elements are disposed to transfer heat to an active body within the activation unit; and (c) the active body disposed to be fired through the activation unit, wherein the active body comprises a plurality of individual flares, and the active body does not include an explosive substance, or a pyrophoric substance, or a combination of the explosive substance and the pyrophoric substance, and wherein the one or more heating elements are held in ceramic that provides mechanical strain relief in a metal structure of the ejection tube, wherein the metal structure corresponds to a respective external shape of the active body disposed to be activated by the activation unit when the active body is fired through the activation unit.

19. An activation unit for activating munitions-free active masses, or active bodies, or flares, used to protect aircraft against heat-seeking threats, wherein the activation unit comprises:

(a) an ejection tube; and (b) one or more high-power heating elements that are fitted around the ejection tube, wherein the one or more heating elements each include at least a heating wire that is supplied with electric current by a regulation unit, wherein the one or more heating elements are disposed to transfer heat to an active body within the activation unit, and each heating wire is embedded at least in a material that minimizes heat loss.

20. The activation unit as clamed in claim 19, wherein the material is a ceramic inlay.

* * * * *